US008805608B2

(12) United States Patent
Matsumoto et al.

(10) Patent No.: US 8,805,608 B2
(45) Date of Patent: Aug. 12, 2014

(54) CRAWLER CONSTRUCTION MACHINE

(71) Applicant: Komatsu Ltd., Tokyo (JP)

(72) Inventors: Hayato Matsumoto, Hiratsuka (JP); Hiroshi Sawada, Neyagawa (JP); Kazuyoshi Morimoto, Hirakata (JP)

(73) Assignee: Komatsu Ltd., Tokyo (JP)

( * ) Notice: Subject to any disclaimer, the term of this patent is extended or adjusted under 35 U.S.C. 154(b) by 14 days.

(21) Appl. No.: 13/811,005

(22) PCT Filed: Oct. 18, 2012

(86) PCT No.: PCT/JP2012/077008

§ 371 (c)(1),
(2), (4) Date: Jan. 18, 2013

(87) PCT Pub. No.: WO2013/175654

PCT Pub. Date: Nov. 28, 2013

(65) Prior Publication Data

US 2014/0150750 A1 Jun. 5, 2014

(30) Foreign Application Priority Data

May 24, 2012 (JP) ..... 2012-118330

(51) Int. Cl.
*F02D 41/24* (2006.01)

(52) U.S. Cl.
USPC ..... 701/104; 701/110; 123/436; 123/472; 123/488

(58) Field of Classification Search
USPC ..... 701/103–105, 110; 123/436, 472, 488, 123/494
See application file for complete search history.

(56) References Cited

U.S. PATENT DOCUMENTS

| | | | | |
|---|---|---|---|---|
| 2010/0167873 | A1 | 7/2010 | Akiyama et al. | |
| 2012/0245760 | A1 * | 9/2012 | Ikeya | 701/1 |
| 2013/0057305 | A1 * | 3/2013 | Jimbo | 324/750.01 |
| 2013/0090835 | A1 * | 4/2013 | Take et al. | 701/103 |
| 2014/0054902 | A1 * | 2/2014 | Kawaguchi et al. | 290/40 B |

FOREIGN PATENT DOCUMENTS

| | | | |
|---|---|---|---|
| JP | 2006-152970 | A | 6/2006 |
| JP | 2008069696 | A | 3/2008 |
| JP | 2008-248523 | A | 10/2008 |
| JP | 2011-156971 | A | 8/2011 |
| JP | 2011250344 | A | 12/2011 |

OTHER PUBLICATIONS

International Search Report dated Nov. 13, 2012 from International Application No. PCT/JP2012/077008, 7 pages.

(Continued)

*Primary Examiner* — Hai Huynh
(74) *Attorney, Agent, or Firm* — Fish & Richardson P.C.

(57) ABSTRACT

In a crawler construction machine including an engine and a fuel adjustment dial that adjusts a speed of the engine according to operation loads of the working equipment, the fuel adjustment dial is a rotary notchless dial that is continuously variably adjustable. The crawler construction machine includes: an adjustment position detector that detects a rotation adjustment position of the fuel adjustment dial; an engine controller that is connected to the adjustment position detector and controls the speed of the engine based on an adjustment position of the fuel adjustment dial; and a display device that is connected to the engine controller and displays on a screen a percentage value of the adjustment position of the fuel adjustment dial in which the maximum rotation position of the fuel adjustment dial is defined as 100%.

4 Claims, 10 Drawing Sheets

(56) References Cited

OTHER PUBLICATIONS

Office Action issued Jan. 23, 2014 in corresponding German Patent Application No. 112012000103.6, including English translation, 14 pages.

International Search Report dated Nov. 13, 2012 from International Application No. PCT/JP2012/07708, 7 pages.

* cited by examiner

CRAWLER CONSTRUCTION MACHINE

CROSS-REFERENCE TO RELATED APPLICATIONS

This application claims priority to Application No. PCT/JP2012/077008 filed Oct. 18, 2012, which application claims priority to Japanese Application No. 2012-118330, filed on May 24, 2012. The contents of the above applications are incorporated herein by reference in their entireties.

TECHNICAL FIELD

The present invention relates to a crawler construction machine.

BACKGROUND ART

Typically, a crawler construction machine such as a hydraulic excavator and a bulldozer includes a fuel adjustment dial to adjust an engine speed according to operations of working equipment.

As this fuel adjustment dial, there has been known a fuel adjustment dial including: a plurality of notches on an outer circumference of a disc provided to a rotation shaft; and a projection having an ejectable and returnable top on a non-rotary part, in which, when the dial is rotated, the projection is engaged with the notch, thereby providing a clicking touch (see, for instance, Patent Literature 1).

CITATION LIST

Patent Literature(s)

Patent Literature 1: JP-A-2006-152970

SUMMARY OF THE INVENTION

Problem to be Solved by the Invention

However, since the fuel adjustment dial including the projection to be engaged with the notch cannot be halted at a position where the projection is past the notch, when the most suitable fuel adjustment state is shown at the position where the projection is past the notch, the dial is moved to antero-posterior notches for engagement. Accordingly, it is difficult to match the dial to a precise fuel adjustment position.

Moreover, in a crawler construction machine, the dial with notches has been conventionally used since the dial may be shifted to another position by vibration or impact during traveling, not by operator's operations.

An object of the invention is to provide a crawler construction machine including a precisely adjustable fuel adjustment dial and allowing an operator to visually check a precise adjustment position of the fuel adjustment dial.

Means for Solving the Problems

According to an aspect of the invention, a crawler construction machine includes: an engine; working equipment; and a fuel adjustment dial that adjusts a speed of the engine according to operations of the working equipment, in which the fuel adjustment dial is a rotary notchless dial that is continuously variably adjustable, and the crawler construction machine further includes: an adjustment position detector that detects a rotation adjustment position of the fuel adjustment dial; an engine controller that is connected to the adjustment position detector and controls the speed of the engine based on an adjustment position of the fuel adjustment dial outputted from the adjustment position detector; and a display device that is connected to the engine controller and displays on a screen the adjustment position of the fuel adjustment dial, which is outputted from the engine controller, in percentage in which a maximum rotation position of the fuel adjustment dial is defined as 100%.

In the crawler construction machine according to the above aspect of the invention, the display device comprises a display restricting unit that restricts to display the fuel adjustment dial in percentage when abnormality occurs in the adjustment position detector, between the adjustment position detector and the engine controller, or between the engine controller and the display device.

In the crawler construction machine according to the above aspect of the invention, the fuel efficiency of the engine is displayed on the screen of the display device, and a percentage value of the fuel adjustment dial is displayed together with the fuel efficiency of the engine.

In the crawler construction machine according to the above aspect of the invention, the fuel efficiency of the engine is displayed on the screen of the display device, and the percentage value of the fuel adjustment dial is positioned near the displayed fuel efficiency of the engine.

According to the above aspect of the invention, since the fuel adjustment dial is a notchless dial, a position of the fuel adjustment dial can be set in any position within the adjustment range, so that the engine can be driven at the most suitable speed corresponding to operation loads of the working equipment.

Moreover, since, by a percentage value display of the adjustment position of the fuel adjustment dial on the monitor device, an operator can recognize the adjustment position of the fuel adjustment dial on the monitor screen watched by the operator during operations, the fuel adjustment dial is easily adjustable in response to the operation conditions. Additionally, with such a percentage value display, the fuel adjustment dial is adjustable in a more refined manner.

According to the above aspect of the invention, since the display restricting unit is provided, when abnormality occurs between the position adjustment detector and the engine controller or between the engine controller and the display device, the operator can recognize the abnormality on the display device, on that the operator can handle the abnormality immediately.

According to the above aspect of the invention, since the percentage value display of the fuel adjustment dial is positioned near the display of the fuel efficiency of the engine, the operator can visually check both the displays, so that the adjustment position of the fuel adjustment dial can be easily set under the most favorable fuel efficiency condition.

DESCRIPTION OF EMBODIMENT(S)

[1] Overall Arrangement

Figure 1:
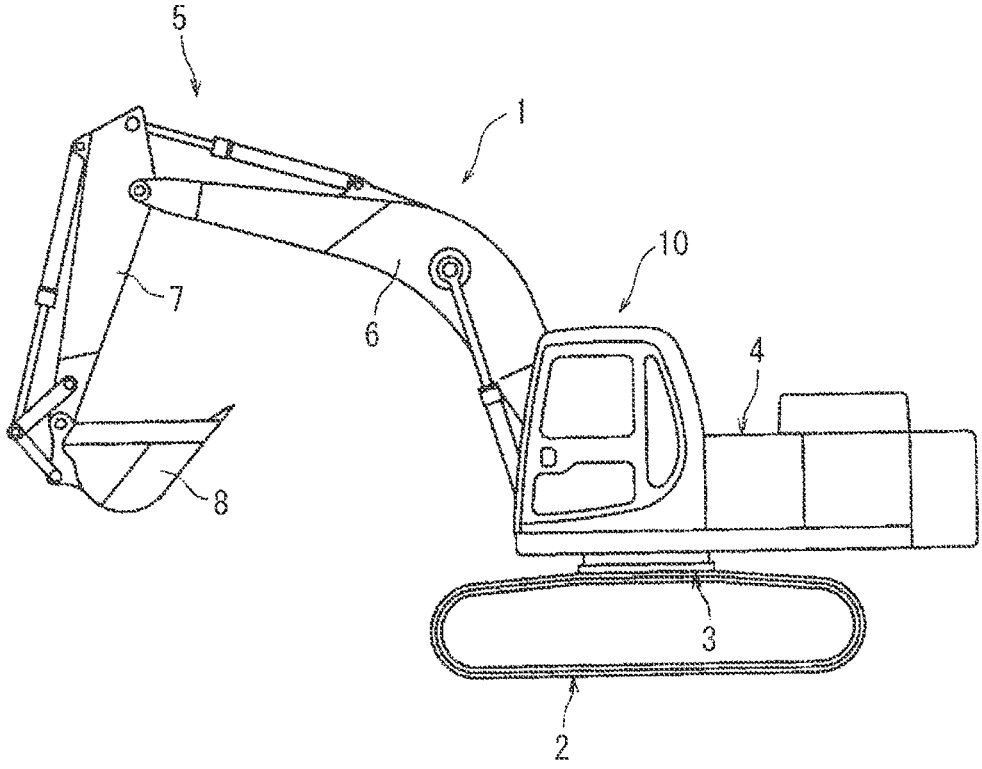
FIG. 1 is a side elevation of a construction machine according to an exemplary embodiment of the invention.

FIG. 1 shows a hydraulic excavator 1 as a construction machine according to a first exemplary embodiment of the invention.

The hydraulic excavator 1 includes: an undercarriage 2 having a pair of crawler belts; an upper revolving body 4 rotatably attached on the undercarriage 2 via a rotating mechanism 3; and working equipment 5 consecutively connected to the upper revolving body 4.

The working equipment 5 includes: a boom 6 whose base is swingably connected to the upper revolving body 4; an arm 7 that is swingably connected to a tip end of the boom 6; and a bucket 8 that is swingably connected to a tip end of the arm 7.

The upper revolving body 4 includes an operator's cab 10 where an operator sits for driving the hydraulic excavator 1.

Figure 2:
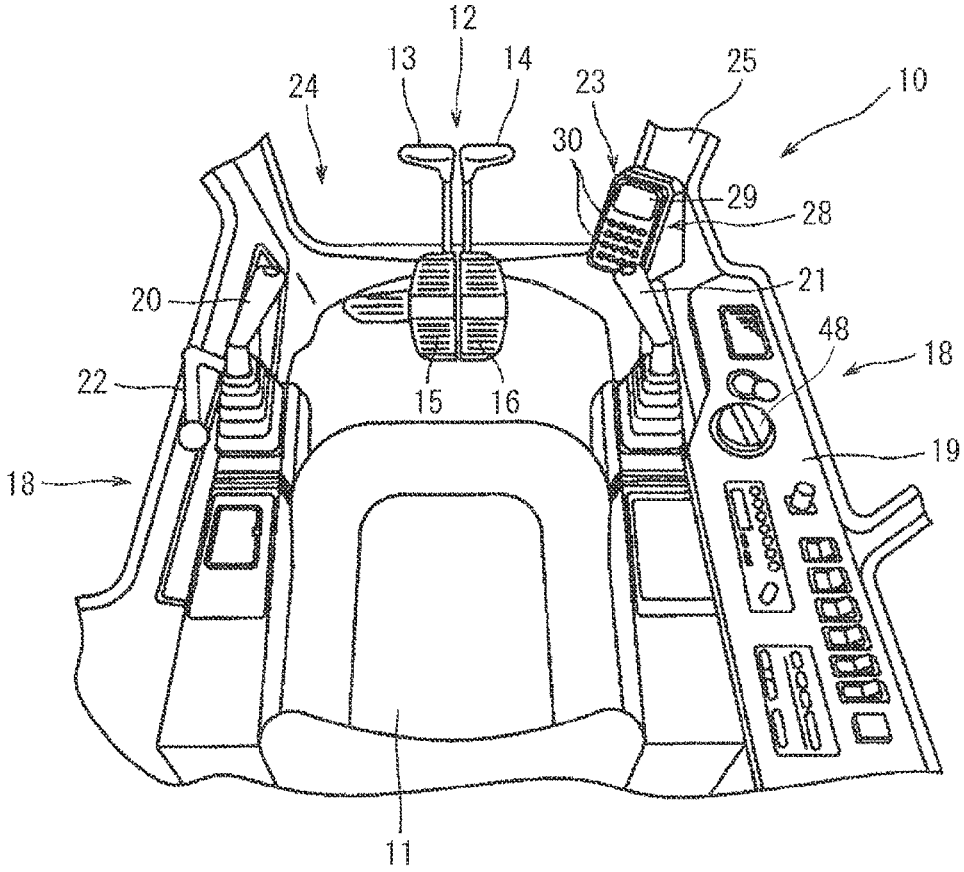
FIG. 2 is a partial perspective view showing an operator's cab of the construction machine according to the above exemplary embodiment.

As shown in FIG. 2, in the operator's cab 10 of the upper revolving body 4, an operator's seat 11 is provided in the center and a traveling operation unit 12 is provided in front of the operator's seat 11. The traveling operation unit 12 includes: travel levers 13 and 14; and travel pedals 15 and 16 that swing together with the travel levers 13 and 14.

In the hydraulic excavator 1 in the exemplary embodiment, the undercarriage 2 is configured to move forward when the travel levers 13 and 14 are pressed forward and move backward when the travel levers 13 and 14 are pulled backward. An instrument panel 19 is provided near a side window 18 on the right of the operator's seat 11.

On the instrument panel 19, a later-described fuel adjustment dial 48 that adjusts a speed of an engine 31 is provided.

Operation levers 20 and 21 are provided on the respective sides of the operator's seat 11. The control lever 20 serves for rotating the arm 7 and revolving the upper revolving body 4. The control lever 21 serves for moving the arm 6 up and down, rotating the bucket 8, and the like. A lock lever 22 is provided near the control lever 20.

The lock lever 22 serves for stopping functions such as operations of the working equipment 5, revolving of the upper revolving body 4 and travel of the undercarriage 2. Specifically, with the pull-up operation of the lock lever 22, movement of the working equipment 5 and the like is locked, where the working equipment 5 and the like are inhibited from working even when the control levers 20 and 21 and the like are operated.

In the operator's cab 10, a monitor device 23 that displays various conditions (e.g., an engine water temperature, a hydraulic oil temperature, and a fuel amount) of the hydraulic excavator 1 is provided.

The monitor device 23 is provided on a lower side of a vertical frame 25 that separates a front window 24 from one of the side windows 18 in the operator's cab 10. On a front surface of an exterior case 28 of the monitor device 23, a monitor screen 29 and an operation switch 30 (i.e., an operation input portion) are provided. The monitor screen 29 is provided, for instance, by a liquid crystal panel. Although the operation switch 30 is formed integrally with the monitor device 23 in the exemplary embodiment, the operation switch may be a separate body from the monitor device. For instance, the operation switch may be provided in the instrument panel 19 and the like in the operator's cab.

[2] Structure of Control System of Hydraulic Excavator 1

Figure 3:
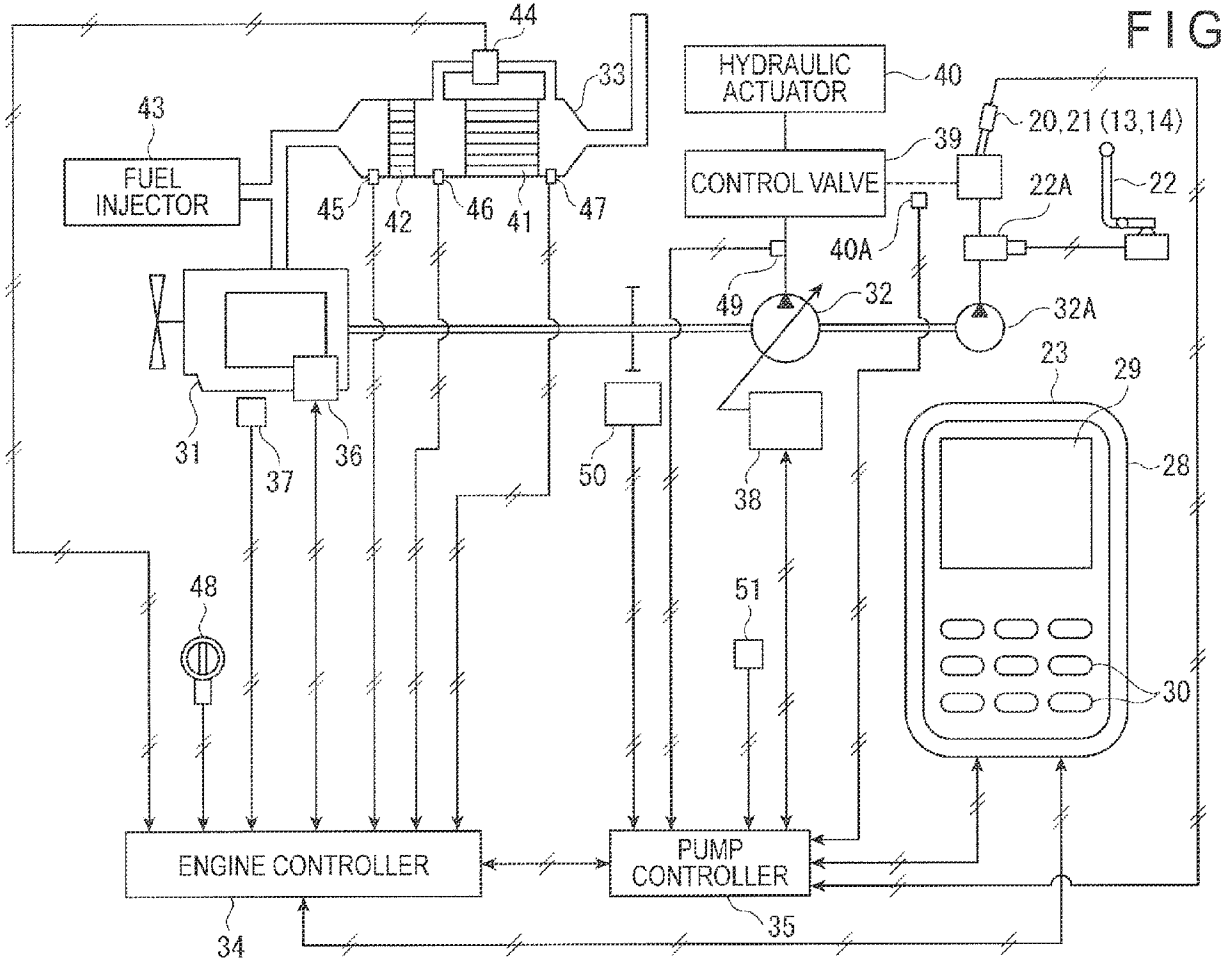
FIG. 3 is a schematic view showing a control system of the construction machine according to the above exemplary embodiment.

FIG. 3 shows a control system of the hydraulic excavator 1.

The control system of the hydraulic excavator 1 is a system for controlling the engine 31, a hydraulic pump 32 and an exhaust gas purifying device 33, and includes an engine controller 34 and a pump controller 35. The aforementioned monitor device 23, engine controller 34 and pump controller 35 are interconnected via CAN (Controller Area Network) in a manner capable of communicating with each other.

The engine 31 is a diesel engine driven by a light oil (fuel oil), and includes: a fuel pump 36 that includes a common rail fuel injector and feeds fuel to a common rail by pressure; and an engine water temperature sensor 37 that detects a water temperature of a cooling water for the engine 31. An output shaft of the engine 31 is connected to the hydraulic pump 32.

The hydraulic pump 32 is an axial piston pump that includes a swash plate driven by a swash-plate drive device 38 and that adjusts a discharge pressure of the hydraulic oil according to a rotation position of the swash plate. A hydraulic actuator 40 is connected to a hydraulic-oil-discharge side of the hydraulic pump 32 via a control valve 39. The hydraulic actuator 40 includes a boom cylinder, an arm cylinder, a bucket cylinder, a hydraulic motor for rotation, a hydraulic motor for travel, and the like.

Moreover, the hydraulic pump 32A for generating a pilot pressure is connected to the hydraulic pump 32. A discharge side of the hydraulic pump 32A is connected to the control levers 20 and 21 and the travel levers 13 and 14 via a pilot line. By operating the control levers 20 and 21 and the travel levers 13 and 14, a discharge pressure of the control valve 39 is changed through the pilot line, whereby the hydraulic actuator 40 of the working equipment 5 is actuated. The engine 31 and the hydraulic pump 32 are provided to the upper revolving body 4.

Further, a solenoid valve 22A is interposed between the hydraulic pump 32A and the control levers 20, 21/the travel levers 13, 14. When the lock lever 22 is operated for a lock, the pilot line is blocked by the solenoid valve 22A, where the hydraulic actuator 40 is not driven even when the control levers 20, 21 and the travel levers 13, 14 are operated.

The pressure sensor 40A is a sensor for detecting whether the control levers 20, 21 and the travel levers 13, 14 are operated. The pressure sensor 40A may be an analog sensor or an on-off sensor. The pressure sensor 40A is, for instance, provided to the pilot line for transmitting the operation of the control levers 20, 21 and the travel levers 13, 14 to the control valve 39. In place of the pressure sensor 40A, a potentiometer may be incorporated in the control lever and determine whether the control levers 20, 21 and the travel levers 13, 14 are operated or not.

The exhaust gas purifying device 33 is a device for removing PM (Particulate Matter) contained in exhaust gas of the engine 31, and includes a filter 41 and an oxidizing catalyst 42.

The filter 41 is made of ceramics and the like, and collects PM contained in the exhaust gas.

The oxidizing catalyst 42 has a function to decrease nitrogen monoxide (NO) while increasing nitrogen dioxide ($NO_2$), among nitrogen oxides (NOx) in the exhaust gas. Moreover, the oxidizing catalyst 42 also has a function to perform a regeneration processing of the filter 41 in which the oxidizing catalyst 42 oxidizes hydrocarbons injected from the fuel injector 43 provided on a more upstream side of an exhaust gas flow than the oxidizing catalyst 42 to burn the PM collected in the filter 41 with reaction heat generated by the oxidization reaction. As the hydrocarbons injected from the fuel injector 43, for instance, a light oil (the fuel) may be used.

The fuel injector 43 is provided in an exhaust line between the engine 31 and the oxidizing catalyst 42 in the exemplary embodiment. However, fuel may be injected to a combustion chamber of the engine 31 at timing during an exhaustion step of the engine 31 and a post injection may be performed to supply unburned fuel to the exhaust gas purifying device 33.

Although the exhaust gas purifying device 33 is arranged to include the oxidizing catalyst 42 on the upstream side of the filter 41, the arrangement of the exhaust gas purifying device 33 is not limited to this. Specifically, the exhaust gas purifying device may be arranged such that the oxidizing catalyst is directly supported in the filter, or such that, while the oxidizing catalyst is directly supported in the filter, another oxidizing catalyst may be provided on the upstream side of the filter.

The exhaust gas purifying device 33 includes: a differential pressure sensor 44 that detects a differential pressure between an inlet and an outlet of the filter 41; and temperature sensors 45, 46 and 47 that respectively detect temperatures at an inlet of the exhaust gas purifying device 33, the inlet of the filter 41 and an outlet of the exhaust gas purifying device 33. Detection values detected by the sensors 45, 46 and 47 are outputted to the engine controller 34 as electric signals.

Although the differential pressure sensor 44 is provided by a single body of differential pressure sensor, the differential pressure sensor 44 may be arranged such that pressure sensors are respectively provided to the inlet and the outlet of the filter 41 to output the respective pressures detected by the pressure sensors to the engine controller 34 as electric signals, where a difference between the respective pressures is obtained.

The engine controller 34 controls the speed of the engine 31 according to the engine speed set by the fuel adjustment dial 48. The water temperature and the like detected by the engine water temperature sensor 37 provided in the engine 31 are outputted to the monitor device 23 as electric signals.

The engine controller 34 controls the speed of the engine 31 based on an electric signal (a throttle voltage) outputted from the potentiometer 487 in the fuel adjustment dial 48, where a value of the electric signal is used not directly but based on a map showing a relationship between a rotation position and a fuel injection amount (an accelerator opening degree), the map being set according to a model, a size and the like of the hydraulic excavator 1.

The engine controller 34 determines whether to perform the regeneration processing of the exhaust gas purifying device 33, based on the electric signals from the differential pressure sensor 44 of the exhaust gas purifying device 33.

In the exemplary embodiment, the engine controller 34 determines based on the pressure whether the regeneration processing of the filter 41 is necessary or not. However, alternative, the engine controller 34 may also determine whether the filter 41 is clogged or not, or whether the regeneration processing is necessary or not, by calculating a discharged PM amount and a burned PM amount using a rotation sensor, a load sensor and a temperature sensor, obtaining a deposited PM amount as a difference between the discharged PM amount and the burned PM amount, and accumulating the deposited PM amount in time series.

The pump controller 35 controls the swash-plate drive device 38 based on a detection value of the engine speed sensor 50 provided to the output shaft that interconnects the pressure sensor 49 detecting the discharge pressure of the hydraulic pump 32, the engine 31 and the hydraulic pump 32. The pump controller 35 also generates, based on the pressure sensor 40A of the pilot line, data of whether the control levers 20, 21 and the travel levers 13, 14 are operated or not, and outputs the data as an electric signal to the monitor device 23.

[3] Structure of Fuel Adjustment Dial 48

Figure 4A:
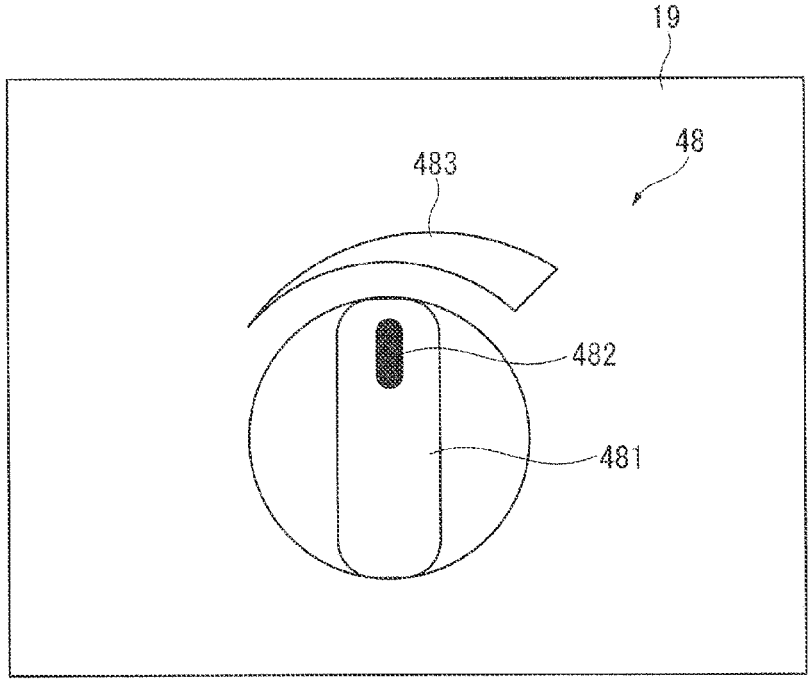
FIG. 4A is a plan view showing a fuel adjustment dial in the above exemplary embodiment.
Figure 4B:
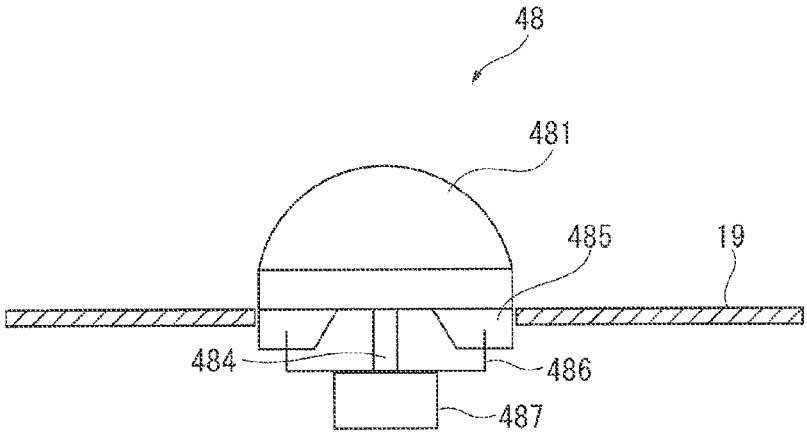
FIG. 4B is a side elevation showing the fuel adjustment dial in the above exemplary embodiment.

FIGS. 4A and 4B show a structure of the fuel adjustment dial 48.

The fuel adjustment dial 48 is a notchless dial whose rotation position is continuously variably adjustable, and is provided on the instrument panel 19 as shown in FIGS. 4A and 4B. The fuel adjustment dial 48 includes a dial body 481, an adjustment reference mark 482, an adjustment amount indicating mark 483, a rotation shaft 484, a downward projection 485, a stopper 486 and a potentiometer 487.

The dial body 481 is formed in a disc in a plan view and includes a knob substantially at the center of the disc, the knob extending and protruding in a diametral direction of the disc.

An upper surface of the knob of the dial body 481 is marked with the adjustment reference mark 482. The adjustment reference mark 482 shows an adjustment position of the fuel adjustment dial 48.

The adjustment amount indicating mark 483 is formed around the dial body 481 of the instrument panel 19. When the knob is turned toward a thicker width of the mark, the speed of the engine 31 is increased, which means that fuel supplied to the engine 31 is increased.

The rotation shaft 484 is connected to the center of the disc of the dial body 481 and is also connected to the potentiometer 487 in a rotatable manner.

The downward projection 485 is integrally formed on a bottom surface of the dial body 481. As the dial body 481 is rotated, the downward projection 485 is also rotated.

Since neither a notch plate formed with a plurality of notches on its outer circumference nor projections to be engaged with the notches is provided on the bottom surface of the dial body 481, the dial body 481 is continuously variably rotated.

The stopper 486 formed in a folded plate is provided around the rotation shaft 484. A standing part of the stopper 486 is in contact with the downward projection 485, thereby restricting further rotation of the dial body 481.

The stopper 486 is provided in two positions within a range in which the fuel adjustment dial 48 is rotatable. The minimum rotation position and the maximum rotation position of the fuel adjustment dial 48 are determined according to the contact position of the stopper 486. The rotation position of the fuel adjustment dial 48 is determined in any position within the range between the minimum rotation position and the maximum rotation position.

According to the rotation position of the fuel adjustment dial 48 set within the range between the minimum rotation position and the maximum rotation position, a throttle voltage is outputted from the potentiometer 487. A relationship between the rotation position of the fuel adjustment dial 48 and the outputted throttle voltage is substantially proportional.

A region of, for instance, a region of the throttle voltage ranging from 0 V of the outputted throttle voltage to approximately less than 10% of an applied voltage and a region of the throttle voltage ranging from approximately more than 90% of the applied voltage to the applied voltage are defined as a failure region.

Figure 5:
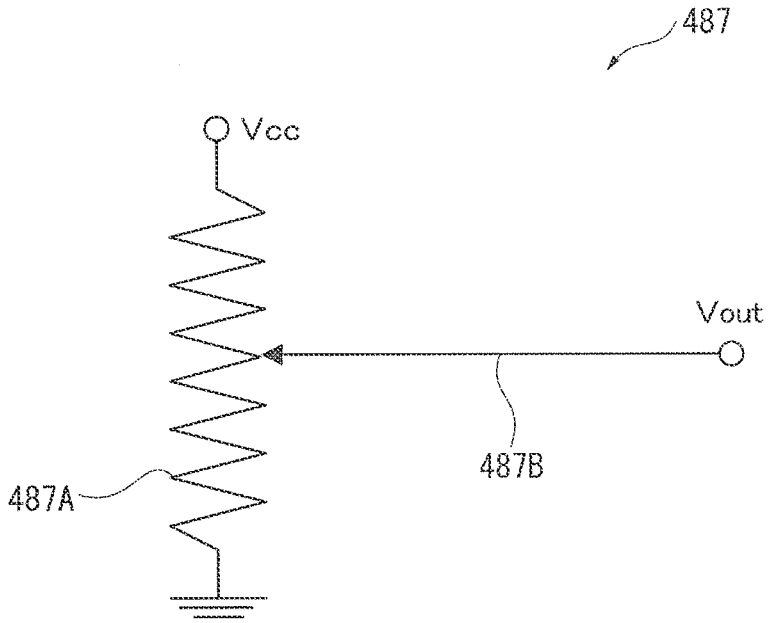
FIG. 5 is a schematic view showing an arrangement of a potentiometer in the fuel adjustment dial in the above exemplary embodiment.

As shown in FIG. 5, the potentiometer 487 includes a resistor 487A that is provided on an inner surface of a cylindrical casing along a circumferential direction of the casing; and a slider 487B that is provided to the rotation shaft 484 and rotates and slides with its tip end in contact with the resistor 487A.

A voltage Vcc is applied to the resistor 487A. The voltage Vcc is divided according to the contact position of the slider 487B to define an output voltage Vout. The voltage Vout is outputted as a throttle voltage to the resistor 487A.

Figure 6:
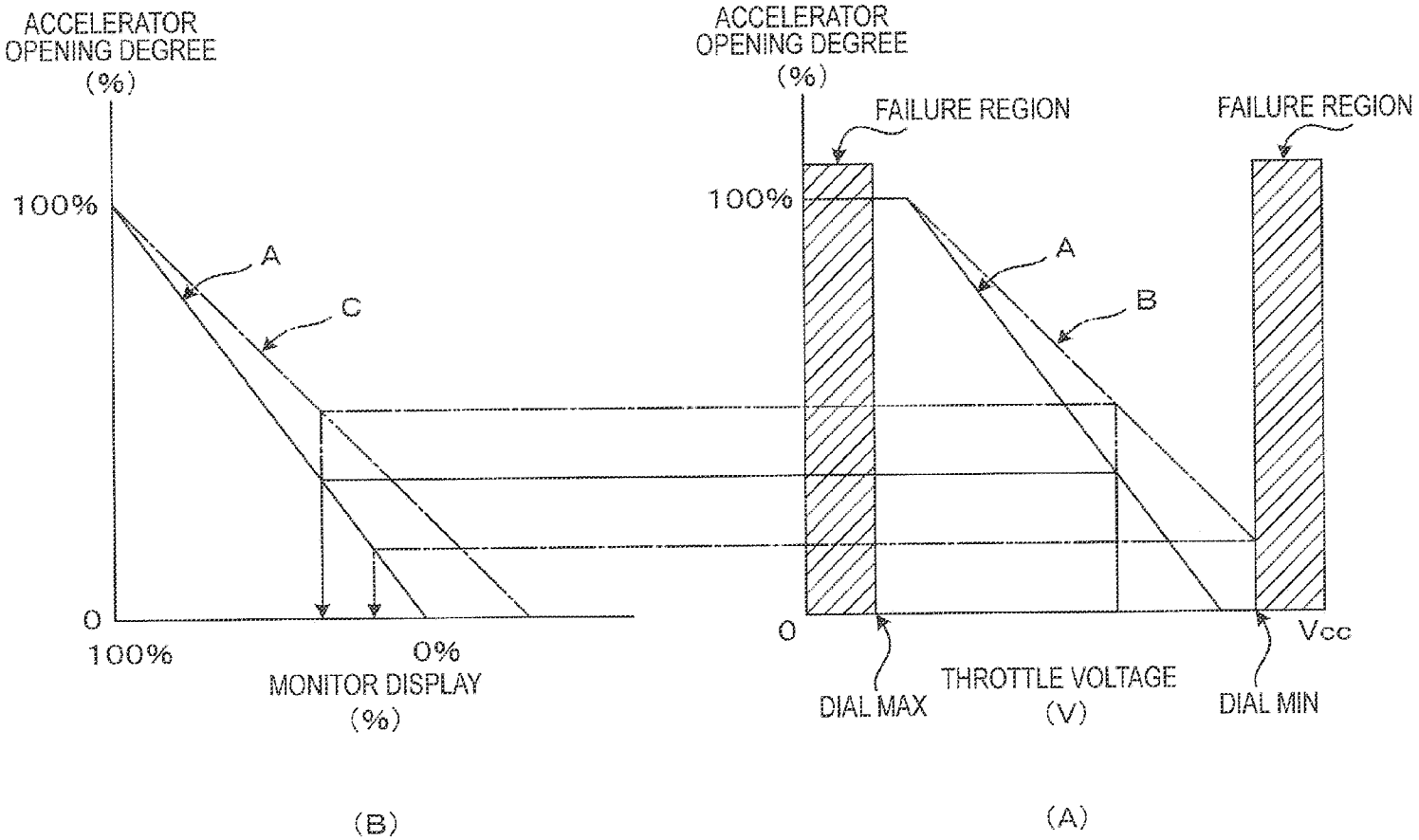
FIG. 6 is a graph showing a relationship between a throttle voltage outputted from the potentiometer and an accelerator opening degree in the above exemplary embodiment.

A relationship between the throttle voltage of the fuel adjustment dial 48 and the accelerator opening degree is set in a substantially proportional graph (map data) as shown in FIG. 6(A). This relationship differs according to models of construction machines. According to the models, the relationship is set as shown in a graph A and a graph B.

In the case of the map data as shown in the graph A, a value (%) of the accelerator opening degree to be determined according to the throttle voltage within an effective region other than the failure region of the throttle voltage falls within values of 0% to 100%. Accordingly, as shown in FIG. 6(B) showing a relationship between the accelerator opening degree and a value displayed on the monitor, the value of the throttle voltage is directly usable for a percentage display on the monitor device 23.

On the other hand, in the case of the map data as shown in the graph B, a percentage value can be displayed in the same manner as in the graph A within the effective range of the throttle voltage. However, since the accelerator opening degree is not zero at the minimum rotation position (a dial MIN) of the fuel adjustment dial 48 in this map data, even when the fuel adjustment dial 48 is adjusted to the minimum rotation position, a percentage value corresponding to the accelerator opening degree is displayed on the monitor screen 29.

Figure 7:
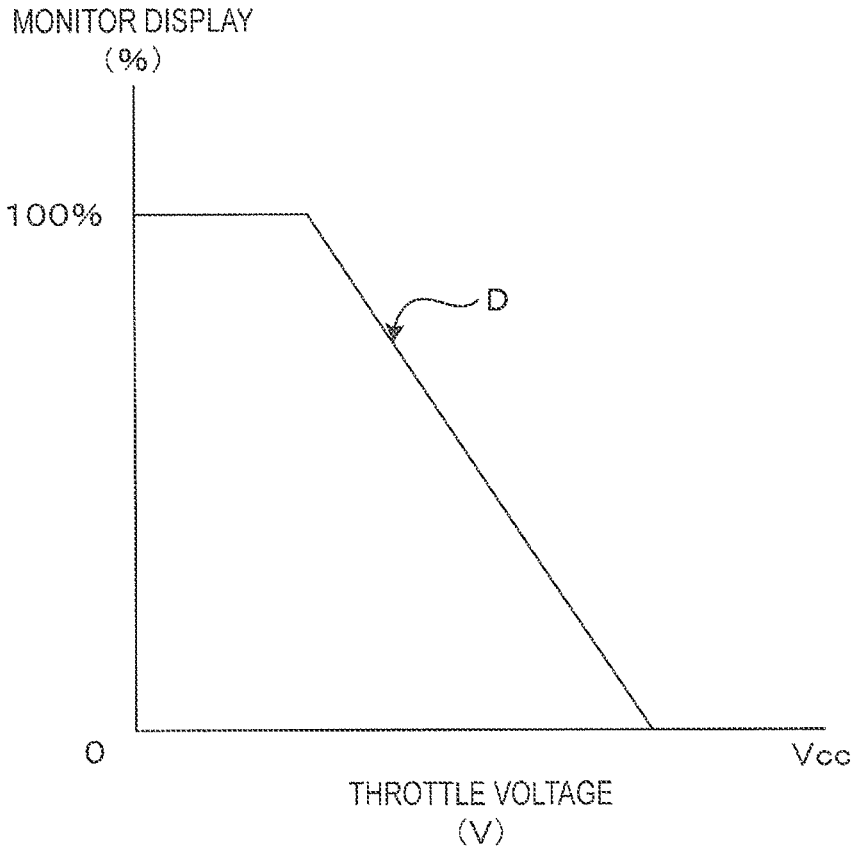
FIG. 7 is a graph showing a relationship between the accelerator opening degree and a percentage value displayed on a monitor in the above exemplary embodiment.

Accordingly, in the model of the construction machine having the relationship of the graph B, a conversion value as shown in a graph C of FIG. 6(B), which is the same as a graph D of FIG. 7 showing a relationship between a throttle voltage corresponding to the graph A and a monitor display (%), is set in advance. An image generator 51 (later described) converts an inputted throttle voltage to an appropriate percentage value for display. Thus, as shown in the graph D of FIG. 7, an appropriate percentage value can be displayed on the monitor device 23 in the same manner as in the model shown in the graph A. Even when the graphs showing the relationship between the throttle voltage and the accelerator opening degree are different while mechanical specifications (e.g., a rotation angle of the dial) are the same, a numerical display corresponding to the accelerator opening degree at a predetermined throttle position can be the same irrespective of models.

In the conversion processing, the image generator 51 may perform conversion using the map data stored therein or by a conversion formula.

[4] Functional Block Diagram in Monitor Device 23

Figure 8:
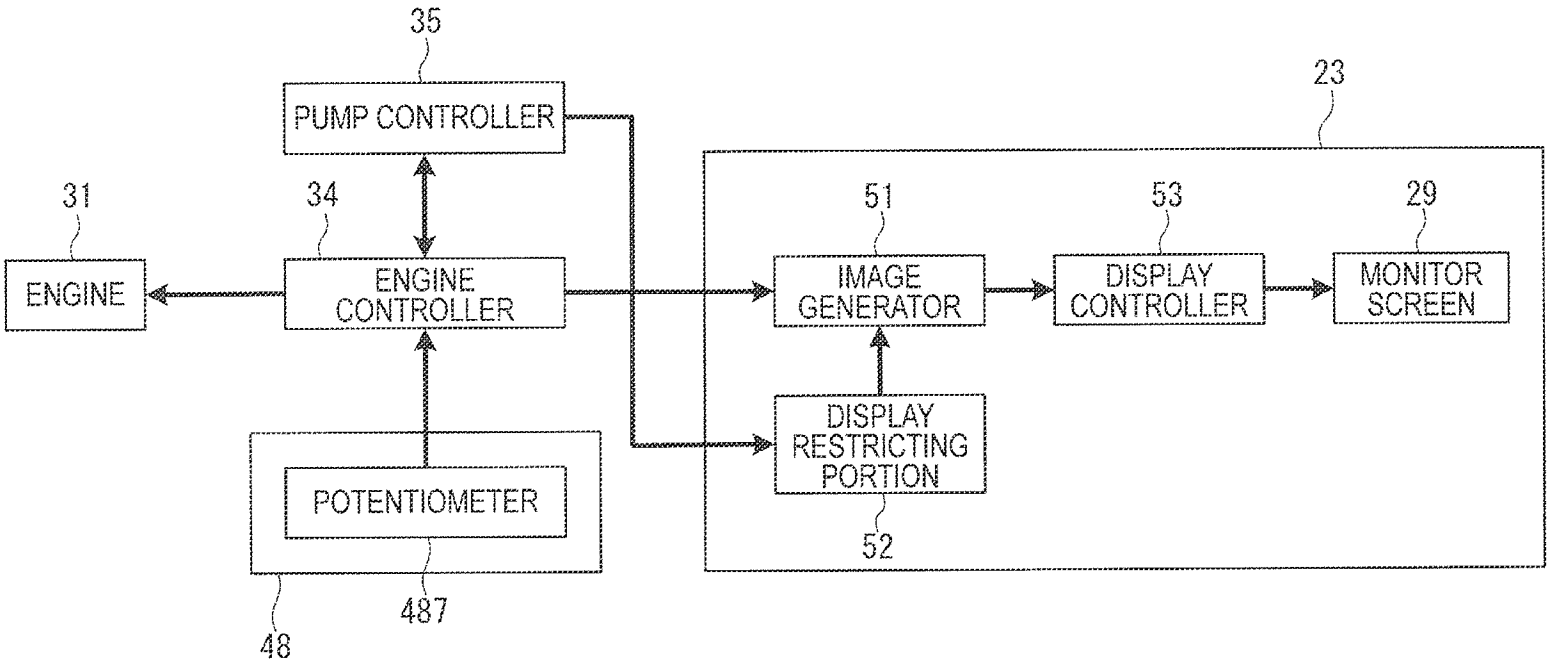
FIG. 8 is a functional block diagram showing an internal structure of a display device in the above exemplary embodiment.

FIG. 8 shows a functional block diagram in the monitor device 23. The monitor device 23 includes the image generator 51, a display restricting portion 52, and a display controller 53.

The image generator 51 generates an image to be displayed on the monitor screen 29 based on an electric signal (throttle voltage) outputted from the engine controller 34 according to the adjustment position of the fuel adjustment dial 48. In the model having the relationship between the throttle voltage and the accelerator opening degree as shown in the graph B in FIG. 6(A), the image generator 51 converts the throttle voltage using the graph C in FIG. 6(B) to generate an image.

Figure 9:
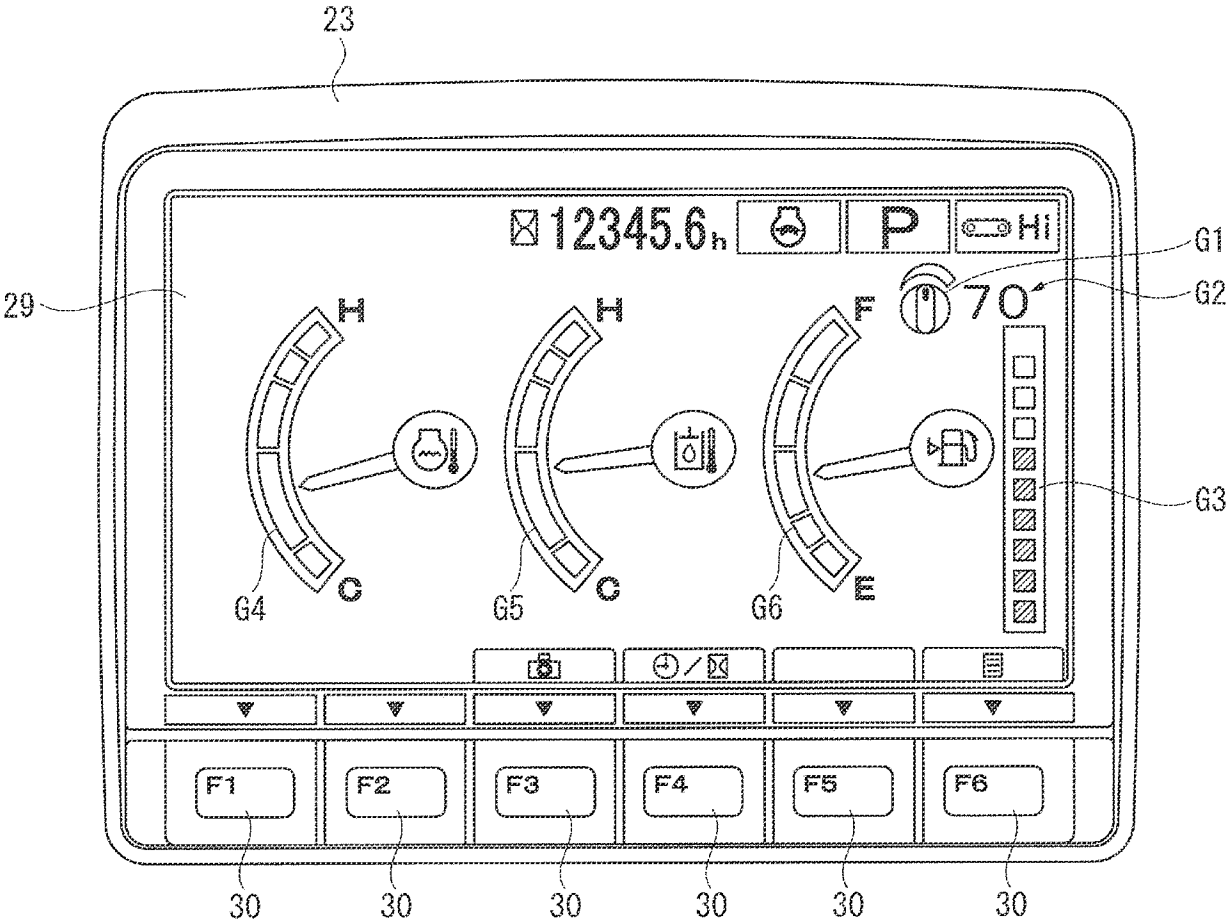
FIG. 9 is a schematic view showing an image displayed on a monitor screen of the display device in the above exemplary embodiment.

Specifically, as shown in FIG. 9, a numerical image G2 equivalent to a percentage value of the fuel adjustment dial 48 is displayed next to an icon image G1 of the fuel adjustment dial 48.

The numerical image G2 may be displayed on the monitor screen 29 together with a display indicating whether the fuel efficiency is favorable or not. For instance, the numerical image G2 is displayed near above the fuel efficiency display bar image G3 provided near the right end of the monitor screen 29.

In the exemplary embodiment, the image generator 51 can display on 100 scales what percentage (%) an opening degree of the fuel adjustment amount is. In the conversion processing, although the image generator 51 performs conversion, other controllers such as the engine controller 34 may be used for conversion.

The display restricting portion 52 serves for restricting to display the numerical image G2 in FIG. 9 when the electric signal outputted from the engine controller 34 according to the adjustment position of the fuel adjustment dial 48 is judged to be abnormal. Specifically, the display restricting portion 52 restricts the image generator 51 from generating the numerical image G2, so that the numerical image G2 is not displayed.

The display controller 53 controls driving of the monitor screen 29 based on the image data generated in the image generator 51, so that the image shown in FIG. 9 is displayed on the monitor screen 29. Although not shown in FIG. 8, based on the detection signals (e.g., the water temperature of the engine 31, a residual fuel amount and the oil temperature of the hydraulic oil) showing driving conditions of a vehicle, as shown in FIG. 9, the cooling water temperature of the engine 31 is displayed as an image G4, the oil temperature of the hydraulic oil is displayed as an image G5, and the residual fuel amount is displayed as an image G6. Although the oil temperature of the hydraulic oil is also displayed in the exemplary embodiment, only the engine water temperature and the residual fuel amount may be displayed.

[5] Operations and Advantages of Embodiment(s)

Figure 10:
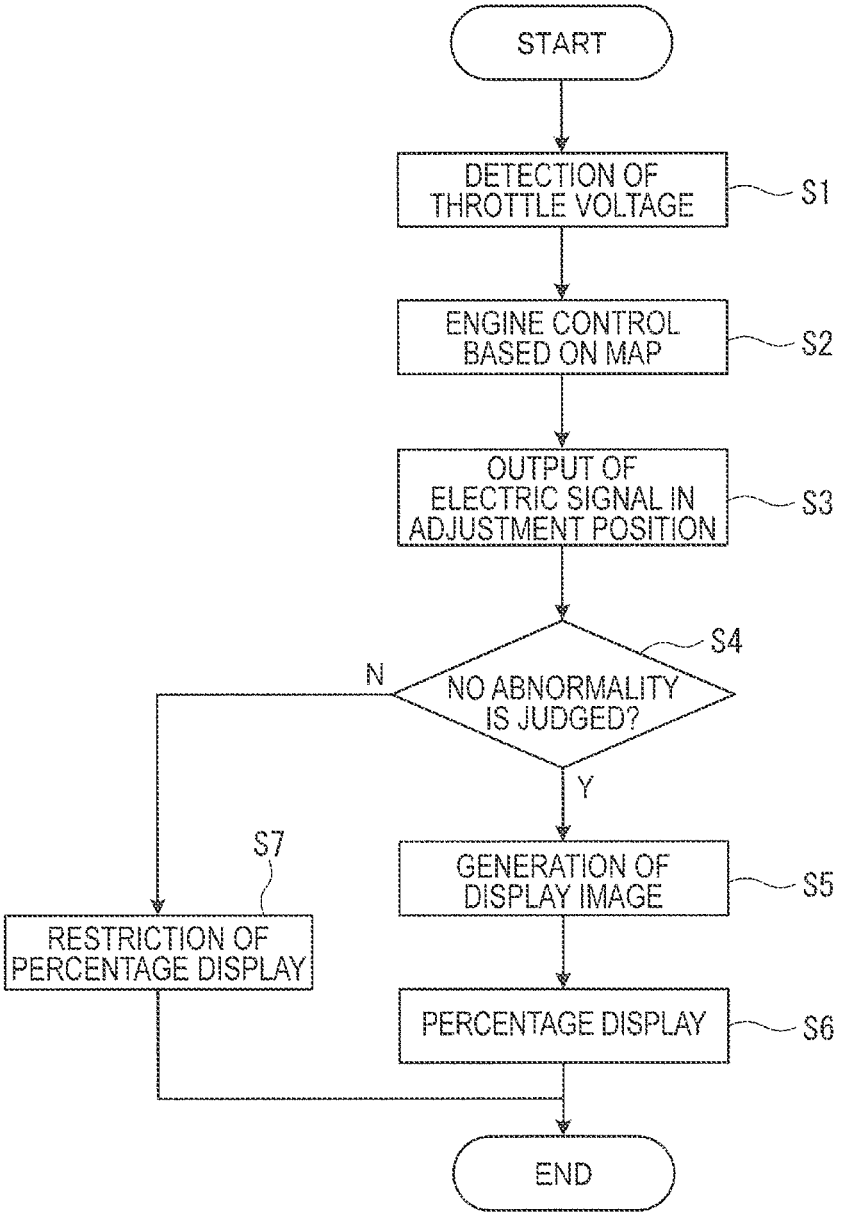
FIG. 10 is a flowchart for explaining operations in the above exemplary embodiment.

Next, operations and advantages of the exemplary embodiment will be described with reference to the flowchart shown in FIG. 10.

The engine controller 34 detects an electric signal (throttle voltage Vout) outputted from the potentiometer 487 of the fuel adjustment dial 48 according to the adjustment position of the fuel adjustment dial 48 (step S1).

Next, the engine controller 34 controls the engine 31 according to the electric signal outputted from the potentiometer 487 based on the aforementioned map shown in FIG. 6(A) (step S2).

Simultaneously, the engine controller 34 outputs the detected electric signal according to the adjustment position of the fuel adjustment dial 48, to the monitor device 23 (step S3).

The display restricting portion 52 of the monitor device 23 determines whether the electric signal outputted from the engine controller 34 is abnormal or not (step S4). Note that abnormality refers to an abnormal output voltage in the aforementioned failure region of the potentiometer 487, an abnormal communication between the potentiometer 487 and the engine controller 34, and an abnormal communication between the engine controller 34 and the monitor device 23.

When no abnormality is determined, the image generator 51 generates the numerical image G2 expressed in percentage based on the electric signal according to the adjustment position of the fuel adjustment dial 48 using the map data in FIG. 6(B) (step S5), and displays the numerical image G2 as a percentage image on the monitor screen 29 together with the icon image G1 (step S6).

On the other hand, when abnormality is determined, the display restricting portion 52 restricts the image generator 51 from generating a display image to restrict display of the numerical image G2, so that a numerical image is not displayed (step S7).

In a dial with notches, when the most operationally suitable dial position in terms of the engine output and the fuel efficiency lies between the notches, the engine output is insufficient for operations at a notch positioned in a smaller numeral of the dial while the fuel efficiency is poor for operations at a notch positioned in a larger numeral of the dial according to the exemplary embodiment. By providing a notchless dial as the fuel adjustment dial 48, since the fuel adjustment dial 48 can be set in any position within the adjustment range, the engine 31 can be driven at the most suitable engine speed corresponding to the operation load of the working equipment 5.

Moreover, since the adjustment position of the fuel adjustment dial 48 is displayed as the numerical image G2 in percentage on the monitor device 23, an operator can recognize the adjustment position of the fuel adjustment dial 48 on the monitor screen 29 watched by the operator during operations, so that the fuel adjustment dial 48 is easily adjustable in response to the operation conditions. Moreover, since the numerical image G2 is displayed in percentage, the fuel adjustment dial 48 is adjustable in a more refined manner.

Further, since the monitor device 23 includes the display restricting portion 52, when any abnormality occurs in the potentiometer 487, between the potentiometer 487 and the engine controller 34, and/or between the engine controller 34 and the monitor device 23, the operator can recognize the abnormality on the monitor device 23, so that the operator can handle the abnormality immediately.

Since the numerical image G2 in percentage of the fuel adjustment dial 48 is displayed on the monitor screen 29 together with the display indicating whether the fuel efficiency is favorable or not, the operator can visually check both the displays, so that the adjustment position of the fuel adjustment dial 48 can be easily set under the most favorable fuel efficiency condition.

It is preferable that the numerical image G2 in percentage of the fuel adjustment dial 48 is positioned near the fuel efficiency display bar image G3 of the engine 31 which is an example of the display showing whether the fuel efficiency is favorable or not.

The invention claimed is:

1. A crawler construction machine comprising:

an engine;

working equipment; and a fuel adjustment dial that adjusts a speed of the engine according to operations of the working equipment, wherein the fuel adjustment dial is a rotary notchless dial that is continuously variably adjustable, and the crawler construction machine further comprises:

an adjustment position detector that detects a rotation adjustment position of the fuel adjustment dial;

an engine controller that is connected to the adjustment position detector and controls the speed of the engine based on an adjustment position of the fuel adjustment dial outputted from the adjustment position detector; and a display device that is connected to the engine controller and displays on a screen the adjustment position of the fuel adjustment dial, which is outputted from the engine controller, in percentage in which a maximum rotation position of the fuel adjustment dial is defined as 100%.

2. The crawler construction machine according to claim 1, wherein the display device comprises a display restricting unit that restricts to display the fuel adjustment dial in percentage when abnormality occurs in the adjustment position detector, between the adjustment position detector and the engine controller, or between the engine controller and the display device.

3. The crawler construction machine according to claim 1, wherein a fuel efficiency of the engine is displayed on the screen of the display device, and a percentage value of the fuel adjustment dial is displayed together with the fuel efficiency of the engine.

4. The crawler construction machine according to claim 3, wherein the fuel efficiency of the engine is displayed on the screen of the display device, and the percentage value of the fuel adjustment dial is positioned near the displayed fuel efficiency of the engine.

* * * * *